United States Patent [19]

Hochmuth

[11] Patent Number: 4,502,397

[45] Date of Patent: Mar. 5, 1985

[54] PRE-DRYING FUEL IN STEAM GENERATOR WITH INTEGRAL DOWN-DRAFT DRYER

[76] Inventor: Frank W. Hochmuth, P.O. Box 186, Brewer, Me. 04412

[21] Appl. No.: 631,865

[22] Filed: Jul. 18, 1984

Related U.S. Application Data

[63] Continuation-in-part of Ser. No. 523,375, Aug. 15, 1983, Pat. No. 4,480,557, which is a continuation-in-part of Ser. No. 333,834, Dec. 23, 1981, abandoned.

[51] Int. Cl.[3] ..... F23G 5/00

[52] U.S. Cl. ..... 110/346; 110/234; 110/315; 122/2

[58] Field of Search ..... 110/234, 346, 256, 315, 110/316; 122/2, 22

[56] References Cited

U.S. PATENT DOCUMENTS

| | | | |
|---|---|---|---|
| 2,483,728 | 10/1949 | Glaser | 110/244 |
| 2,925,055 | 2/1960 | Millers et al. | 110/105 |
| 3,168,074 | 2/1965 | Kerhner et al. | 110/234 |
| 3,393,652 | 7/1968 | Connell | 110/234 |
| 3,647,405 | 3/1972 | Smith | 110/234 |
| 3,893,426 | 7/1975 | Bryers | 110/245 |
| 4,019,465 | 4/1977 | Regan et al. | 110/234 |
| 4,102,279 | 7/1978 | Groschl et al. | 110/234 |
| 4,213,405 | 7/1980 | Lis et al. | 110/234 |
| 4,235,174 | 11/1980 | Spurrell | 110/234 |

*Primary Examiner*—Henry C. Yuen

*Attorney, Agent, or Firm*—W. R. Hulbert

[57] ABSTRACT

Method of improving the operation and efficiency of a steam generating furnace fired with high moisture content fuel, comprises providing a drying shaft parallel and offset from the combustion chamber of the furnace; wet fuel is introduced into the upper portion of the shaft while a portion of the hot products of combustion gases from the upper portion of the combustion chamber are also permitted to flow into the upper portion of the shaft. The hot gases evaporate moisture from the fuel and are simultaneously cooled thereby so as to increase in density and fall by gravity within the shaft co-currently with the fuel for recirculation into the lower portion of the combustion chamber while the at least partially dried fuel is deflected from the bottom of the shaft into the lower portion of the combustion chamber along with the recirculated gases.

4 Claims, 5 Drawing Figures

PRE-DRYING FUEL IN STEAM GENERATOR WITH INTEGRAL DOWN-DRAFT DRYER

This is a continuation-in-part of application, Ser. No. 523,375, filed Aug. 15, 1983, now U.S. Pat. No. 4,480,557, which is in turn a continuation-in-part of application, Ser. No. 333,834, filed Dec. 23, 1981, now abandoned.

BACKGROUND OF THE INVENTION

This invention relates to a method of improving the operation and efficiency of a steam generating furnace adapted to burn high moisture content fuel comprising a novel method for pre-drying the fuel prior to its entry into the combustion chamber.

Waste wood, as a by-product of the paper mill industry, has long been burned in furnaces to generate steam. Hogged or waste wood generally has a very high moisture content, being on the order of 50–70% water. In the past, in order to maintain stable burning conditions of waste wood, a secondary fuel such as oil or natural gas has been necessary. In recent years, as these fuels have become scarcer and more expensive, ways have been sought for burning wet waste wood with a minimum use of secondary fuels. Pre-drying the wood helps in this regard, causing it to burn faster and hotter with greater stability, higher efficiency and higher specific combustion rates.

High moisture content fuels, of course, are not limited to wood. Examples of other types of such fuels include bagasse, peat, sludges, garbage, etc. As used herein the term "wet fuel" or "high moisture content fuel" is intended to mean and include any type of such fuel suitable for burning in a furnace.

One present means of drying high moisture content fuel prior to burning it is to introduce it into the upper portion of the combustion chamber of a furnace, so that some of the moisture is removed as it falls downwardly through the ascending hot products of combustion onto a grate at the bottom. Such an arrangement is shown in Glaeser, U.S. Pat. No. 2,483,728, and in Wood, U.S. Pat. No. 1,427,045. Another arrangement is disclosed in Lis, et al., U.S. Pat. No. 4,213,405 in which fuel fed onto an inclined grate is pre-dried as it descends and is then discharged onto a second grate.

A major disadvantage of the Glaeser and Wood method is that unburned fuel and pollutants are entrained in the gases leaving the furnace rather than being retained and burned on or above the grate. A disadvantage of the method disclosed by Lis, et al. is the large grate area and special furnace arches that result in higher first costs and maintenance.

Fluidized bed furnaces, as described in Bryers, U.S. Pat. No. 3,893,426, are another means which have been used to burn high moisture content fuels. Bryers provides two combustion chambers in which hot gas flow is upward in both. Solid fuel is introduced into only one of them. A characteristic of fluidized bed furnaces is that they must be operated at temperatures (1200° F.–1800° F.) significantly lower than those used in traditional combustion furnaces (2200° F.–2400° F.). The present invention is not applicable to fluidized bed furnaces of the type disclosed by Bryers.

It is, accordingly, an object of the invention to provide in a high moisture content fuel burning steam generating furnace of the traditional combustion type a novel and relatively inexpensive method for predrying the wet fuel so as to increase the stability and efficiency of burning of the fuel while reducing the generation and release to the atmosphere of particulate and gaseous pollutants.

SUMMARY OF THE INVENTION

According to the invention, there is provided a method of pre-drying wet fuel to be fed onto the grate of the combustion chamber of a furnace which comprises providing a combustion-free drying shaft offset from the combustion chamber; introducing some of the hot gases from the combustion chamber together with wet fuel to be dried into the upper portion of the shaft, thereby cooling the gases and increasing their density relative to the gases in the combustion chamber, whereby a downward concurrent flow of falling fuel and gases cooled thereby is created in the shaft, and directing the thus dried fuel onto the grate from the lower portion of the shaft while recycling the cooled gases through the combustion chamber.

A preferred method includes the step of laterally deflecting and distributing the fuel from the shaft into the lower end of the combustion chamber onto and above the grate; assisting the deflecting and distribution by air jets; deflecting at least some of the fuel by an inclined surface located above and offset from the grate, such deflection and distribution being assisted by air jets discharged both above and through the inclined surface.

Further objects, features and advantages of the invention will be apparent from the following description of a preferred embodiment of a furnace for practicing the novel method taken in conjunction with the accompanying drawings.

DESCRIPTION OF PREFERRED EMBODIMENT

Figure 1:
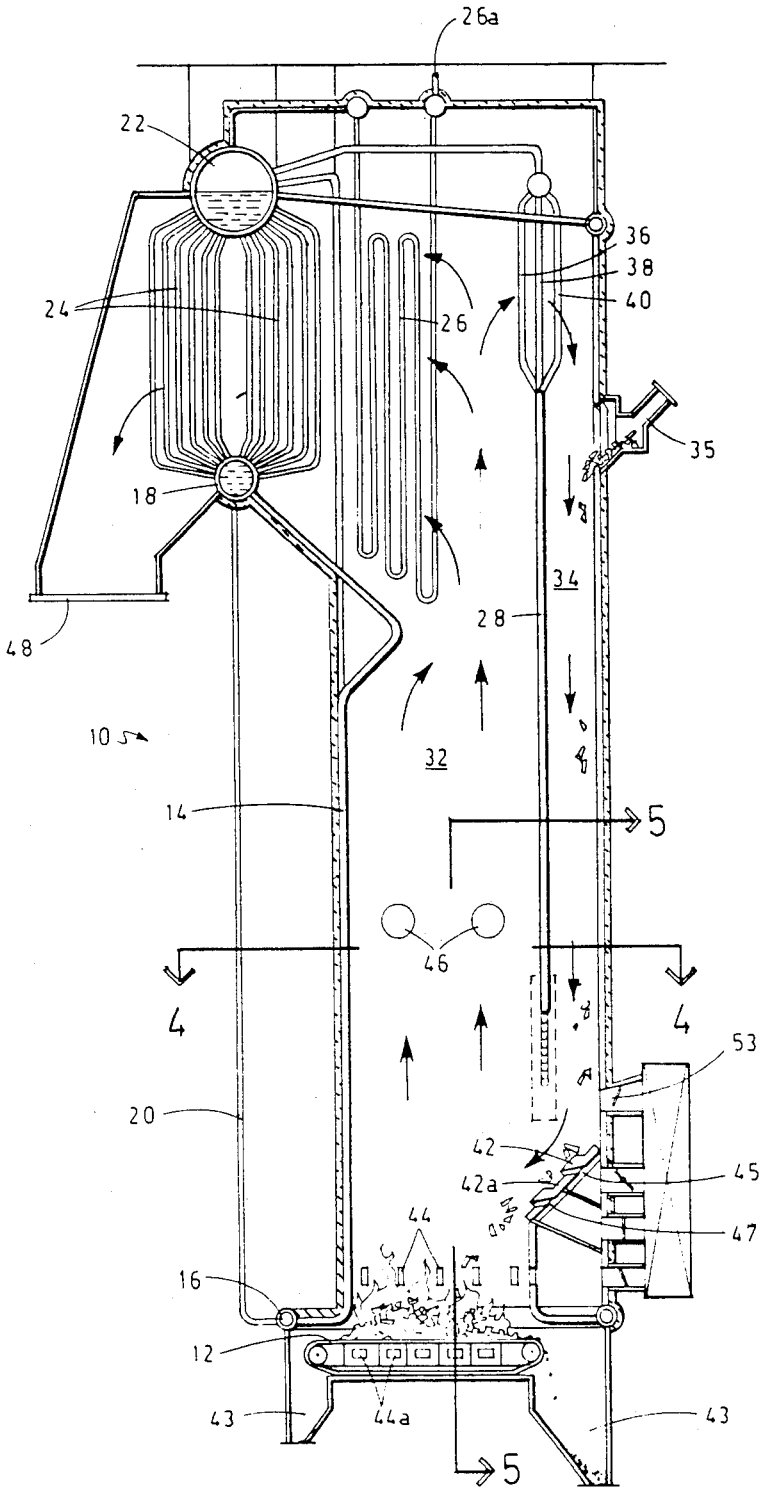
FIG. 1 is a vertical sectional side view of one embodiment of a waste wood fired, steam generating furnace for practicing the invention.
Figure 2:
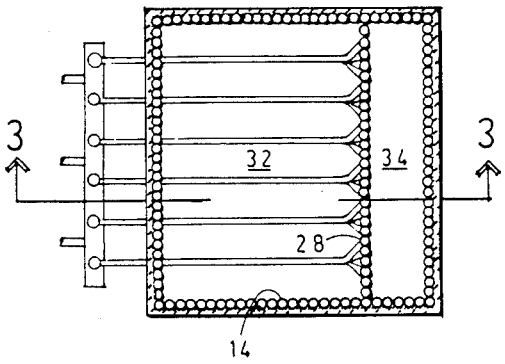
FIG. 2 is a horizontal cross-section of an alternate embodiment of a steam furnace for practicing the invention taken on line 2—2 of FIG. 3 including a screen of water tubes above the grate of the combustion chamber.

As shown in FIG. 1, a waste wood fired steam generating furnace 10 includes a drying shaft 34 offset from a combustion chamber 32 having a travelling grate 12 on which the wood is burned. The combustion chamber is preferably lined with water cooled tubes 14 which are supplied by ring headers 16. Headers 16 receive water from the lower drum 18 through a downcomer 20. A mixture of steam and water exits from the upper ends of tubes 14 into the drums 22 and 18. Steam is also generated in the boiler section 24 of the unit. The steam is discharged from drum 22 to superheater 26, and from there flows to its ultimate point of use through outlet 26*a*.

Figure 4:
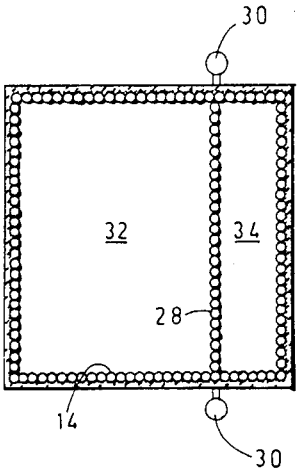
FIG. 4 is a horizontal cross-section taken on line 4—4 of the embodiment shown in FIG. 1.
Figure 3:
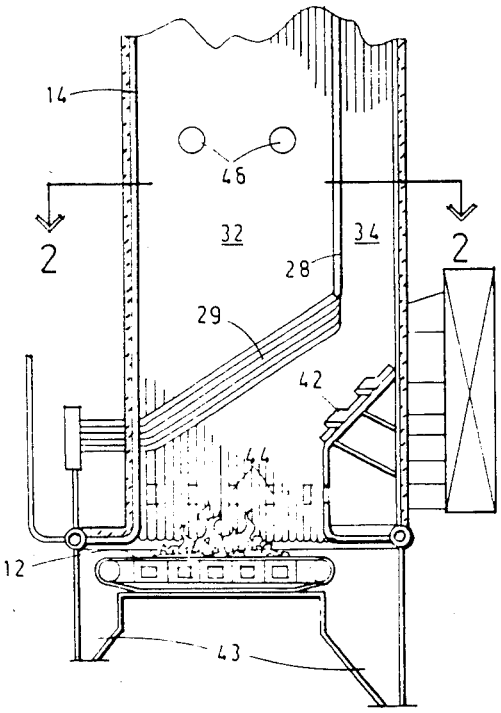
FIG. 3 is a sectional side view of the same taken on line 3—3 of FIG. 2.
Figure 5:
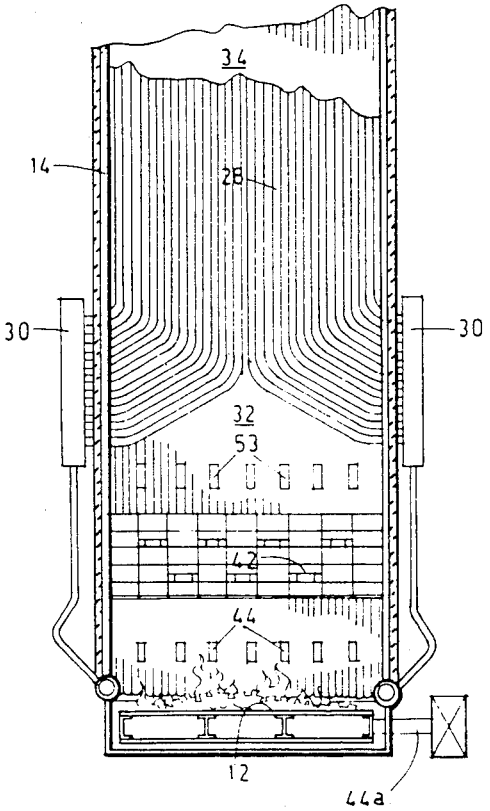
FIG. 5 is a vertical sectional view taken on line 5—5 of FIG. 1.

Additional steam is generated in tubes 28, which tubes receive water from lower headers 30, as shown in FIG. 5. The steam and water mixture flows through tubes 28 to the upper drum 22. Tubes 28 may form a screen 29 across the main furnace flow path (FIGS. 2 and 3), or may be bent to the side (FIGS. 4 and 5). In either case they are bent and fastened together, as by welding or by webs, so as to form a panel or wall (FIGS. 1 through 5), dividing the furnace interior into two vertical passageways defining a combustion chamber 32 and a drying shaft 34 (FIGS. 1, 2, 3 and 4). The optional screen 29 across the furnace flow path (FIGS. 2 and 3) prevents heat radiation from the furnace onto the grate 12, if auxiliary fuel is being burned in the auxiliary fuel burners 46 (FIG. 1). This reduces grate maintenance.

At their upper ends, tubes 28 are separated and bent out of the single plane into three planes, 36, 38 and 40, to form a passageway between the upper portions of shafts 32 and 34.

As shown in FIGS. 4 and 5, another arrangement is disclosed wherein the bending of the lower portions of tubes 28 to the sides in the plane of wall 28 defines the fuel admitting opening opposite ledge 42.

The waste wood is introduced into the upper end of drying shaft 34 through ports 35, and falls through shaft 34 toward the grate 12. Some of the falling pieces of waste wood hit and are deflected by the inclined surface of ledge 42, before being dispersed above or falling the remaining distance onto the upper run of the travelling grate 12. The exposed surface of the ledge is protected by suitable wear and heat resistant castings 42*a*. The grate can travel in either direction, as desired. Ashes are discharged from the grate 12 into ash hoppers 43. Air is introduced above the grate 12 through ports 44, and additional air is introduced beneath the upper grate run through ports 44*a*. Firing of the wood can closely follow load changes of the unit by controlling the air flow to the various air introduction ports. Additional air is introduced just above and through the ledge 42 through any of ports 53, 45 and 47, and each can be separately controlled to distribute the fuel particles evenly on and above the grate 12. By proper air introduction, most of the fines can be burned in suspension above the grate thereby improving air flow through the resultant fuel bed.

Auxiliary fuel burners 46 are provided in the furnace, so that when there is insufficient waste wood to generate steam, the unit can be fired with an auxiliary fuel such as coal, gas or oil. Air can also be introduced through burners 46, to further complete the combustion of the waste wood. The combustion gases, after giving up most of their heat to the heat absorbing surfaces, are exhausted from the furnace through duct 48.

The following describes the operation of the novel furnace according to the invention. Waste wood is burned on and above the grate 12, with the combustion gases flowing upwardly through the combustion chamber 32. Of the order of 75% to 80% of the combustion gases flow to the furnace outlet 48 from the top of the passageway 32, passing over the superheater surface 26 and boiler surface 24, before being discharged. The other approximately 20% to 25% of the hot gases flow to the right (as seen in FIG. 1), through the separated tubes 36, 38 and 40, into the upper end of the drying shaft 34. High-moisture content waste wood is introduced into the upper end of the drying shaft 34 through ports 35. The hot gases entering the drying shaft contact the wet fuel and in so doing some of the heat in the gases causes water to evaporate from the fuel which reduces the temperature of the gases thereby increasing the density of the gases in the drying shaft relative to those in the furnace and causing them to flow by gravity toward the bottom of the shaft.

In a typical example, the temperature of the gas passing into the drying shaft is 1700° F. and the fuel fall is 70 feet. Under these conditions, approximately one-half pound of water would be evaporated per pound of dried fuel. If effect, then, a fuel having a 60% water content at the feed point will be dried to a 50% water content as it leaves the drying shaft. If the entering fuel has a water content of 55%, then the fuel will be dried to a 42% water content. To obtain these conditions about 20% to 25% of the furnace gas must be recirculated through the drying shaft 34.

Gas recirculation through the drying shaft 34 is caused by the difference in density between the gases in the combustion chamber 32 and those in the drying shaft 34. The gases in the drying shaft 34 are cooled by contact with the wet fuel and the resultant average temperature in the shaft is much less than the average temperature of the gas in the main furnace passageway 32. The hot lower density furnace gas flows upwardly in the combustion chamber while the cooled denser gas flows downwardly in the drying shaft. This is quite similar to forces that cause water flow in a natural circulation boiler. It should be noted that the gas recirculation is essentially self-regulating. The more wet fuel that is fed into the drying shaft, the cooler the gas becomes, and the greater the recirculation. For any given set of conditions the size and height of the drying shaft must be set to take into account the gas temperature and the desired water evaporation from the fuel.

While there has been shown and described a presently preferred embodiment for practicing the invention it will nevertheless be understood that the same is meant to be be by way of illustration and not by way of limitation. It is intended that the scope of the invention be limited only by the proper interpretation to be accorded the appended claims.

I claim:

1. The method of pre-drying wet fuel to be fed onto and or above the grate of the combustion chamber of a furnace which comprises providing a combustion-free drying shaft offset from said combustion chamber introducing some of the hot gases from the combustion chamber together with wet fuel to be dried into the upper portion of said shaft, thereby cooling said gases and increasing their density relative to the gases in said combustion chamber whereby a downward concurrent flow of falling fuel and gases cooled thereby is created in said shaft, and laterally deflecting and distributing the thus dried fuel to from the lower portion of said shaft into the lower end of said combustion chamber onto and above said grate while recycling the cooled gases through said combustion chamber.

2. The method as defined in claim 1 wherein said deflecting and distribution is assisted by air jets.

3. The method as defined in claim 2 wherein at least some of said fuel is deflected by an inclined surface located above and offset from said grate.

4. The method as defined in claim 3 wherein such deflection and distribution is assisted by air jets discharging both above and through said surface.

* * * * *

UNITED STATES PATENT AND TRADEMARK OFFICE

CERTIFICATE OF CORRECTION

PATENT NO. : 4,502,397
DATED : March 5, 1985
INVENTOR(S) : Frank W. Hochmuth

It is certified that error appears in the above-identified patent and that said Letters Patent are hereby corrected as shown below:

On the title page;

In the References Cited "Glaser" should be --Glaeser--

Col. 4, line 8: "If" should be --in--

Col. 4, line 36: Delete "be" after "to"

Signed and Sealed this

*Fifteenth* Day of *October 1985*

[SEAL]

*Attest:*

*Attesting Officer*

DONALD J. QUIGG

*Commissioner of Patents and Trademarks—Designate*

UNITED STATES PATENT AND TRADEMARK OFFICE

CERTIFICATE OF CORRECTION

PATENT NO. : 4,502,397

DATED : March 5, 1985

INVENTOR(S) : Frank W. Hochmuth

It is certified that error appears in the above-identified patent and that said Letters Patent is hereby corrected as shown below:

Column 4, line 55, delete "to" after "fuel"

Signed and Sealed this

*Twenty-sixth* Day of *November 1985*

[SEAL]

*Attest:*

DONALD J. QUIGG

*Attesting Officer*

*Commissioner of Patents and Trademarks*